United States Patent [19]

Arakelian et al.

[11] 4,112,273

[45] Sep. 5, 1978

[54] PUSH-PULL ELECTRIC SWITCH

[75] Inventors: Edward M. Arakelian; Terrance W. Maugans, both of Kokomo, Ind.

[73] Assignee: General Motors Corporation, Detroit, Mich.

[21] Appl. No.: 846,422

[22] Filed: Oct. 28, 1977

[51] Int. Cl.[2] ..... H01H 15/18; H01H 15/24

[52] U.S. Cl. ..... 200/67 D; 200/16 A; 200/76; 200/153 K; 200/159 A

[58] Field of Search ..... 200/16 R, 16 A, 16 D, 200/67 R, 67 A, 67 D, 67 DA, 67 DB, 76, 77, 153 R, 153 K, 159 R, 159 A, 159 B, 283

[56] References Cited

U.S. PATENT DOCUMENTS

| | | | |
|---|---|---|---|
| 2,335,283 | 11/1943 | Johnson | 200/16 A |
| 2,802,082 | 8/1957 | Kalwo | 200/159 A |
| 2,918,544 | 12/1959 | Koenig | 200/76 |
| 3,045,092 | 7/1962 | Bundy | 200/16 A X |
| 3,551,614 | 12/1970 | Babler | 200/16 A |
| 3,676,618 | 7/1972 | Bartens | 200/77 |
| 3,769,474 | 10/1973 | Deubel et al. | 200/76 |
| 4,006,322 | 1/1977 | Gallatin et al. | 200/16 A |
| 4,032,731 | 6/1971 | Bryceland | 200/153 K |

FOREIGN PATENT DOCUMENTS

| | | | |
|---|---|---|---|
| 1,034,522 | 7/1953 | France | 200/16 A |

*Primary Examiner*—Stephen Marcus
*Attorney, Agent, or Firm*—Edward J. Biskup

[57] ABSTRACT

A push-pull electric switch having a pair of spherically shaped contact plates which normally bias an actuator towards a neutral position. The contact plates are formed with contact tabs that are engageable with stationary contact members when the actuator is moved in opposite directions.

3 Claims, 5 Drawing Figures

PUSH-PULL ELECTRIC SWITCH

Figure 1:
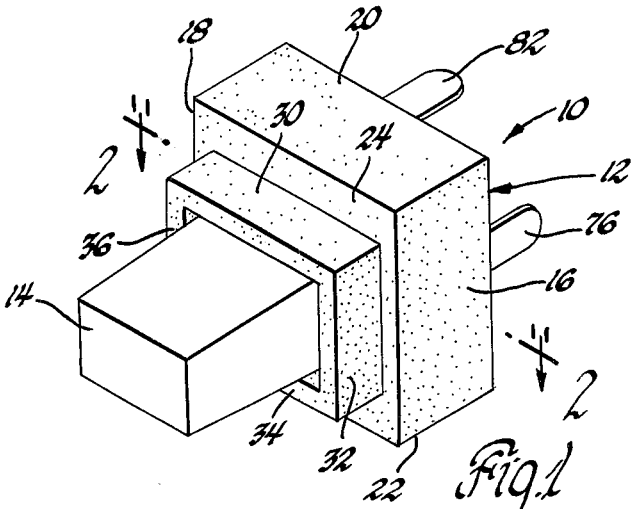

This invention concerns electric switches and more particularly relates to a push-pull snap-action type switch which has three positions and a tactile feel when actuated.

In the preferred form, the switch made in accordance with the invention includes a housing that is formed of a non-conducting material such as plastic and has a generally rectangular chamber formed therein which is defined by four side walls, a front wall and a rear wall. A pair of spring contact plates are located in the chamber and each is spherically shaped and formed with a plurality of leg portions. The leg portions of one of the contact plates engages the rear wall while the leg portions of the other contact plate engages the front wall in a manner whereby the convex surfaces of the contact plates face each other. Each of the contact plates has an aperture formed centrally therein that is axially aligned with an opening formed in the front wall of the housing. An actuator in the form of an elongated rod has an inner portion which extends into the housing through the opening in the front wall and through the apertures in each of the contact plates. The actuator also has an outer portion located externally of the housing and is formed with a button that is movable manually for realizing shifting movement of the rod in an axial direction. The inner portion of the rod is rigidly formed with an enlarged member that is located between the contact plates and is of a size greater than the size of the apertures in the contact plates so that the latter normally biases the actuator to a neutral position. Each of the contact plates has integral contact tabs formed therewith which are normally positioned opposite a pair of stationary contact members carried by the associated wall of the housing. The arrangement is such that when the actuator is moved axially in one direction or in a direction opposite to said one direction, one or the other of the contact plates is flexed so as to move the contact tabs thereof into engagement with the associated contact members after which the self-restoring design of the contact plate returns the actuator to the neutral position.

The objects of the present invention are to provide a new and improved switch having a pair of spherical contact plates which serve as spring members to normally maintain an actuator in a neutral position and carry contact tabs that are movable by the actuator into engagement with stationary contact members; to provide a new and improved switch having an actuator in the form of a rod that is movable along its longitudinal axis in opposite directions to alternately close contact members and that provides a tactile feel when the switch is moved to either of the closed positions; and to provide a new and improved push-pull switch having a pair of contact plates that are dome-shaped and serve as spring members for continuously biasing an actuator towards a neutral position and are capable of being alternately flexed through an actuator for closing the contacts of the switch.

Figure 2:
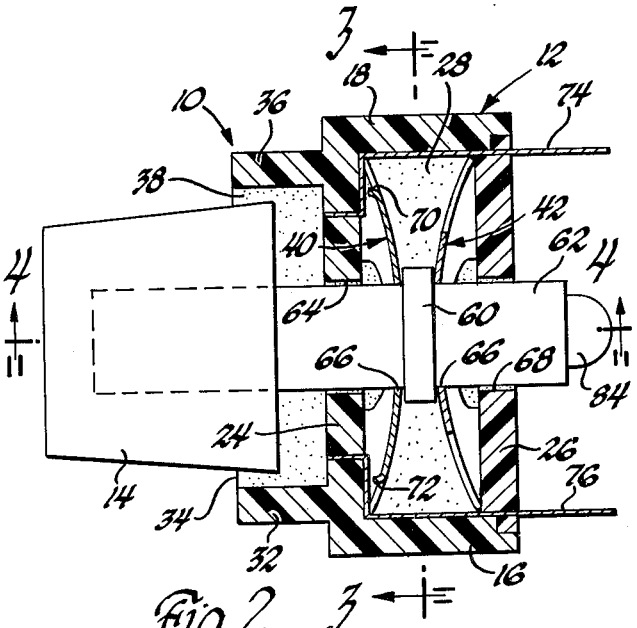
Figure 3:
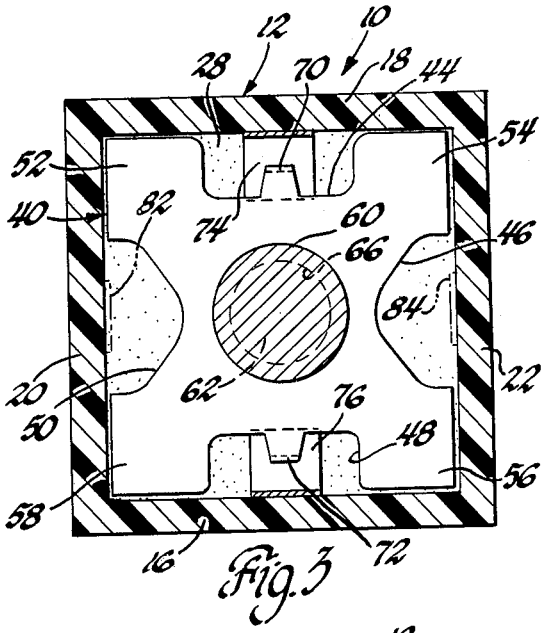
Figure 4:
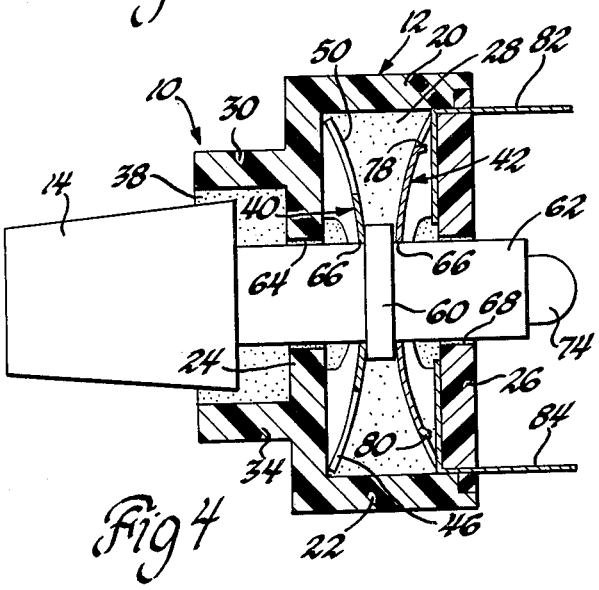
Figure 5:
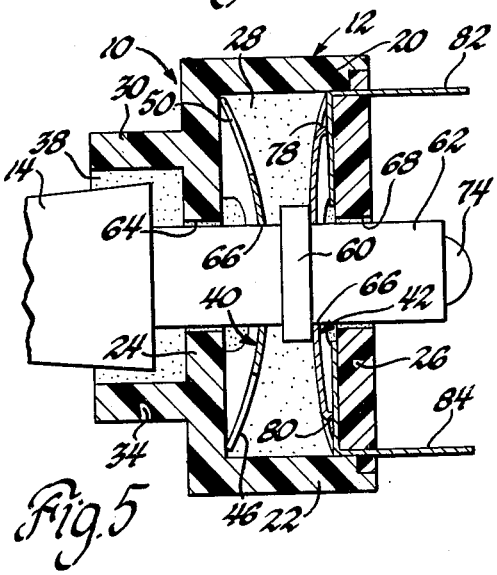

Other objects and advantages of the present invention will be apparent from the following detailed description when taken with the drawings in which:

FIG. 1 is an isometric view showing a switch made in accordance with the invention, FIG. 2 is an enlarged sectional view taken on lines 2—2 of FIG. 1, FIG. 3 is a sectional view taken on lines 3—3 of FIG. 2, FIG. 4 is a sectional view taken on lines 4—4 of FIG. 2, and FIG. 5 is a view similar to FIG. 4 but shows one of the contact plates in the flexed position.

Referring to the drawings and more particularly to FIG. 1, a switch 10 according to the invention is shown which can be grouped with similar switches and incorporated with an electronically tuned radio for purposes of automatically providing preset frequencies for the listener. The switch 10 includes a housing 12 which supports a push button 14 that is part of an actuator that can be manually moved towards and away from the housing and is intended to provide a function similar to the push buttons normally found with vehicle radios at the present time. In this case, however, when the button 14 is manually grasped and moved outwardly relative to the housing 12, a desired frequency of the radio will be electronically stored after which the same frequency will be recalled from memory by simply moving the same button towards the housing 12. Thus, the switch 10 can be catagorized as a push-pull type switch providing the functions as explained above.

More specifically and as seen in FIGS. 2 and 3, the housing 12 comprises a pair of side walls 16, 18, a top wall 20, and a bottom wall 22 all of which are interconnected with a front wall 24 and rear wall 26. The walls 16 through 22 together with the front and rear walls 24 and 26 define a rectangular chamber 28 which in this instance is essentially square. The front wall 24 is integrally formed with an outwardly projecting shield which consists of walls 30, 32, 34 and 36 which define a rectangular pocket 38 into which the inner end of the button 14 is located. The shield provides a more finished appearance to the switch 10 in that it conceals the blunt inner end of the button 14.

The chamber 28 in the housing 12 serves to support a pair of identical spring contact plates 40 and 42 which as seen in FIGS. 2 and 3 are dome or spherically shaped. Each of the contact plates 40, 42 is generally rectangular in configuration as seen in FIG. 3 and has cut-out portions 44, 46, 48 and 50 at the side edges thereof. The cut-out portions 46 and 50 are identical in shape and size. Similarly, the cut-out portions 44 and 48 are identical in shape and size and together with the cut-out portions 46 and 50 serve to define leg portions 52, 54, 56 and 58. The contact plates 40 and 42 are made from an electrically conducting metal and are positioned within the chamber 28 in a manner so that the leg portions of the contact plate 42 engage the rear wall 26 while the leg portions of the contact plate 40 engage the front wall 24.

As seen in FIGS. 2 and 4, the convex surfaces of the contact plates 40 and 42 face each other and are normally spaced at their centers a predetermined distance as determined by an enlarged radially extending annular member 60 rigidly formed with an elongated rod 62, the outer portion of which at one end is rigid with the button 14. The rod 62 extends through a circular opening 64 formed in the front wall 24 and also through a circular aperture 66 centrally formed in each of the contact plates 40, 42. The rod 62 also extends through a circular opening 68 formed in the rear wall 26. Thus, the openings 64 and 68 in the front and rear wall respectively serve as guides during axial movement of the actuator along the longitudinal axis of the rod 62. Both openings 64 and 68 as well as the aperture 66 formed in each of the contact plates have their centers axially aligned so as to allow the aforementioned axial movement of the actuator.

As seen in FIG. 3, the contact plate 40 is formed with integral contact tabs 70 and 72 which in this case are bent in the direction of the front wall 24 and are respectively located opposite identical stationary "Z" shaped contact members 74 and 76 fixedly attached to the front wall 24 and each having a terminal portion that extends through and out of the rear wall 26. Similarly, the contact plate 42 is formed with identical contact tabs 78 and 80 which in this case project towards the rear wall 26 and are respectively located opposite "L" shaped contact members 82 and 84 which also include terminal portions that extend out of the rear wall 26. It will be noted that the contact tabs 70 and 72 are located along a vertical axis while the contact tabs 78 and 80 are located along a horizontal axis as seen in FIG. 3.

As should be apparent from the above description, when the button 14 is manually moved towards the rear wall 26, the member 60 causes a force to be applied to the center of the contact plate 42 causing the latter to flex towards the rear wall 26 as seen in FIG. 5 so that the contact tabs 78 and 80 engage the contact members 82 and 84. During such time, the central portion of the contact plate 42 moves towards the rear wall 26 causing the leg portion 52 through 58 to move slightly laterally outwardly and some clearance is provided for this purpose in the design of the housing 12. Inasmuch as the contact plate 40 is a spherically shaped, as seen in FIGS. 2 and 4, the resiliency of the spring metal causes a snap action to occur which, upon release of the button 14, permits the inherent characteristics of the spring metal to restore the contact plate to the full line or neutral position shown in FIGS. 2 and 4. Similarly, when the button 14 is moved outwardly relative to the housing 12, the member 60 applies a force to the central portion of the contact plate 40 causing the latter to flex towards the front wall 24 so as to move the contact tabs 70 and 72 into engagement with the contact members 74 and 76 fixed with the front wall 24. As in the case with the contact plate 42, the shape of the contact plate and the fact that it is made of spring metal permits the contact plate to return to the full line neutral position of FIG. 2.

One switch sample made in accordance with the invention utilized identical contact plates which were essentially square in configuration and had side dimensions which from corner to corner measured 12.7 mm. The aperture 66 formed in the contact plate had a diameter of 3.3 mm and the rod 62 had a diameter of 3.1 mm. The cut-out portions 46 and 50 had a length and width of 6 and 3 mm respectively, while the cut-out portions 44 and 48 had a length and width of 7.7 and 2 mm respectively. The contact plate was a section of a sphere having a radius that measured 35 mm and was made from a sheet of 18–8 stainless steel having a thickness equal to 0.10 mm. The stainless steel had a hardness equal to C-35/45 and the contact tabs 70 and 72 were centrally located in the associated cut-out portions and had a length of approximately 1 mm.

Various changes and modifications can be made in this construction without departing from the spirit of the invention. Such changes and modifications are contemplated by the inventors and they do not wish to be limited except by the scope of the appended claims.

We claim:

1. A push-pull electric switch comprising a housing having a chamber defined by interconnected top, bottom and side walls and a front wall and a rear wall, front and rear spring contact plates located in said chamber, each of said contact plates being spherically shaped and having a plurality of leg portions formed therewith, the convex surfaces of the contact plates facing each other and each of said contact plates having an aperture centrally formed therein, the front wall of said housing having an opening therein which is axially aligned with the apertures in each of said contact plates, an actuator in the form of a rod having an inner portion extending into said housing through the opening in the front wall and the apertures in each of said contact plates, said actuator having an outer portion located exteriorly of said housing, an enlarged member rigidly formed with said inner portion and located between said contact plates and being of a size greater than the size of each aperture in said contact plates so that the latter normally biases said actuator to a neutral position, a pair of contact tabs formed with each of said contact plates, and a pair of stationary contact members carried by said front wall and said rear wall and located opposite to the pair of contact tabs formed with the associated contact plate whereby axial movement of the actuator in one direction causes the member to flex the rear contact plate towards the rear wall so that the contact tabs thereof engage the contact members on the rear wall while axial movement of the actuator in a direction opposite to said one direction causes the member to flex the front contact plate towards the front wall so that the contact tabs thereof engage the associated contact members mounted on the front wall.

2. A push-pull electric switch comprising a housing made of insulating material, said housing having a chamber defined by interconnected top, bottom and side walls and a front wall and a rear wall, front and rear spring contact plates located in said chamber, each of said contact plates being spherically shaped and having a plurality of leg portions formed therewith, said rear contact plate having its leg portions engaging the rear wall and the front contact plate having its leg portions engaging the front wall so that the convex surfaces of the contact plates face each other, each of said contact plates, having an aperture centrally formed therein, the front wall of said housing having an opening therein which is axially aligned with the apertures in each of said contact plates, an actuator in the form of a rod having an inner portion extending into said housing through the opening in the front wall and the apertures in each of said contact plates, said actuator having an outer portion located exteriorly of said housing, an enlarged member rigidly formed with said inner portion and located between said contact plates and being of a size greater than the size of each aperture in said contact plates so that the latter normally biases said actuator to a neutral position, a pair of contact tabs formed with each of said contact plates, and a pair of stationary contact members carried by said front wall and said rear wall and located opposite to the pair of contact tabs formed with the associated contact plate whereby axial movement of the actuator in one direction causes the member to flex the rear contact plate towards the rear wall so that the contact tabs thereof engage the contact members on the rear wall while axial movement of the actuator in a direction opposite to said one direction causes the member to flex the front contact plate towards the front wall so that the contact tabs thereof engage the associated contact members mounted on the front wall.

3. A push-pull electric switch comprising a housing made of insulating material, said housing having a chamber defined by interconnected top, bottom and side walls and a front wall and a rear wall, front and rear generally rectangular spring contact plates located in said chamber, each of said contact plates being arcuately shaped in cross section and having four leg portions formed therewith, said rear contact plate having its leg portions engaging the rear wall and the front contact plate having its leg portions engaging the front wall so that the convex surfaces of the contact plates face each other, each of said contact plates having an aperture centrally formed therein, the front wall of said housing having an opening therein which is axially aligned with the apertures in each of said contact plates, an actuator in the form of a rod having an inner portion extending into said housing through the opening in the front wall and the apertures in each of said contact plates, said actuator having an outer portion located externally of said housing, an enlarged annular member rigidly formed with said inner portion and located between said contact plates and being of a size greater than the size of each aperture in said contact plates so that the latter normally biases said actuator to a neutral position, a pair of contact tabs formed with each of said contact plates, and a pair of stationary contact members carried by said front wall and said rear wall and located opposite to the pair of contact tabs formed with the associated contact plate whereby axial movement of the actuator in one direction causes the member to flex the rear contact plate towards the rear wall so that the contact tabs thereof engage the contact members on the rear wall while axial movement of the actuator in a direction opposite to said one direction causes the member to flex the front contact plate towards the front wall so that the contact tabs thereof engage the associated contact members mounted on the front wall.

* * * * *